US010134337B2

(12) United States Patent
Lee et al.

(10) Patent No.: US 10,134,337 B2
(45) Date of Patent: Nov. 20, 2018

(54) DISPLAY DEVICE AND METHOD OF CONTROLLING POWER INTEGRATED CIRCUIT

(71) Applicant: LG DISPLAY CO., LTD., Seoul (KR)

(72) Inventors: Jinwon Lee, Paju-si (KR); Suhyuk Jang, Paju-si (KR); Hyojin Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 10 days.

(21) Appl. No.: 15/377,505

(22) Filed: Dec. 13, 2016

(65) Prior Publication Data

US 2017/0169765 A1 Jun. 15, 2017

(30) Foreign Application Priority Data

Dec. 14, 2015 (KR) ..... 10-2015-0178471

(51) Int. Cl.

| | |
|---|---|
| ***G09G 3/20*** | (2006.01) |
| ***G09G 3/3258*** | (2016.01) |
| *G09G 3/3233* | (2016.01) |

(52) U.S. Cl.

CPC ..... *G09G 3/3258* (2013.01); *G09G 3/20* (2013.01); *G09G 3/3233* (2013.01); *G09G 2300/0819* (2013.01); *G09G 2300/0852* (2013.01); *G09G 2300/0861* (2013.01); *G09G 2310/027* (2013.01); *G09G 2310/0251* (2013.01); *G09G 2310/0262* (2013.01); *G09G 2310/08* (2013.01); *G09G 2320/0204* (2013.01); *G09G 2320/0233* (2013.01); *G09G 2320/0247* (2013.01); *G09G 2320/043* (2013.01); *G09G 2330/025* (2013.01); *G09G 2330/028* (2013.01); *G09G 2330/06* (2013.01)

(58) Field of Classification Search

CPC ..... G09G 3/3258; G09G 2310/08; G09G 2310/027

See application file for complete search history.

(56) References Cited

U.S. PATENT DOCUMENTS

2008/0252795 A1 10/2008 Bone et al.
2009/0128479 A1* 5/2009 Yeo ..... G09G 3/3406 345/102
2011/0273433 A1 11/2011 Ahn et al.

FOREIGN PATENT DOCUMENTS

| | | |
|---|---|---|
| CN | 101441855 A | 5/2009 |
| CN | 102568411 B | 1/2015 |
| TW | 201225051 A1 | 6/2012 |

* cited by examiner

*Primary Examiner* — Carolyn R Edwards
(74) *Attorney, Agent, or Firm* — Birch, Stewart, Kolasch & Birch, LLP

(57) ABSTRACT

Provided are a display device and a method of controlling a power integrated circuit (PIC) thereof. The display device in one embodiment includes a controller for generating a switch pulse signal synchronized with an input image and initializing the switch pulse signal during a frame blank period in which the input image is not present; and a power integrated circuit (PIC) driven according to the switch pulse signal to generate power of a display panel. A duty ratio of the switch pulse signal is aligned to be greater than 0 and equal to or less than 3% during an alignment period set within a frame blank period, compared with a normal period. Thus, a change in the duty ratio of the switch pulse signal within the frame blank period is controlled to be minimized to prevent a degradation of image quality due to the variation of power.

15 Claims, 8 Drawing Sheets

DISPLAY DEVICE AND METHOD OF CONTROLLING POWER INTEGRATED CIRCUIT

This application claims the priority benefit of Korean Patent Application No. 10-2015-0178471 filed on Dec. 14, 2015, the entire contents of which is incorporated herein by reference for all purposes as if fully set forth herein.

BACKGROUND OF THE INVENTION

Field of the Invention

The present invention relates to a display device in which a switch pulse signal synchronized with an input image signal is generated outside of a power integrated circuit and supplied to the power integrated circuit and the switch pulse signal is initialized during a frame blank period in which an image signal is not input, and a method of controlling a power integrated circuit thereof.

Discussion of the Related Art

Various display devices such as a liquid crystal display (LCD) device, an organic light emitting display device, a plasma display panel (PDP), an electrophoretic display device (EPD), and the like, have been developed.

An LCD device displays an image by controlling an electric field applied to liquid crystal molecules according to a data voltage. In an active matrix driving type LCD device, a thin film transistor (TFT) is formed in every pixel.

An active matrix type organic light emitting display device includes a self-luminous organic light emitting diode (OLED) and has high luminous efficiency, brightness, and viewing angle. The OLED includes an organic compound layer formed between an anode electrode and a cathode electrode. The organic compound layer includes a hole injection layer (HIL), a hole transport layer (HTL), an emission layer (EML), an electron transport layer (ETL), and an electron injection layer (EIL). When a driving voltage is applied to the anode electrode and the cathode electrode, holes which have passed through the hole transport layer HTL and electrons which have passed through the electron transport layer (ETL) are moved to the emission layer EML to form excitons, and as a result, the emission layer EML generates visible light.

In the display device, when output power of a power integrated circuit (PIC) is changed, a defective screen (image) of a display panel occurs. In particular, in the organic light emitting display device, output power from the PIC directly affects pixels, and thus, a screen (image) is changed to be vulnerable to a change in an output from the PIC.

The PIC generates power required for a display panel and a driving circuit of the display panel upon receiving a switch pulse signal. The switch pulse signal may be generated within the PIC or may be generated by an external circuit and supplied to the PIC. When the switch pulse signal is generated within the PIC, since power from the PIC is not synchronized with an input image, although power of the PIC is finely changed, noise may be seen in a screen and wavy noise may be seen in such a manner that a change in brightness flows like waves.

A method for generating a switch pulse signal by an external circuit is divided into a method for generating a switch pulse signal not synchronized with an input image signal and a method for generating a switch pulse signal synchronized with an input image signal. The former method has the same problem as that of the internal generation method. In the latter case, a frame rate and the switch pulse signal may not be synchronized or a duty ratio of the switch pulse signal may be considerably changed at an initialization timing of the switch pulse signal to cause flicker, glitch, and the like, to be seen on a screen.

SUMMARY OF THE INVENTION

An aspect of the present disclosure provides a display device in which when a switch pulse signal is transmitted in synchronization with an input image signal to a power integrated circuit (PIC) and the switch pulse signal is initialized at each frame for the purpose of synchronization, a change in a duty ratio is reduced to prevent a degradation of image quality, and a method for controlling a PIC thereof.

In an aspect, a display device includes a controller generating a switch pulse signal synchronized with an input image and initializing the switch pulse signal during a frame blank period in which the input image is not present; and a power integrated circuit (PIC) driven according to the switch pulse signal to generate power of a display panel. The switch pulse signal may have a duty ratio varied within an alignment period set within the frame blank period. The duty ratio of the switch pulse signal may be aligned to be greater than 0 and equal to or less than 3% during the alignment period, compared with a normal period other than the alignment period.

The controller may receive a reference clock generated to have a uniform frequency regardless of the frame rate and a pulse width parameter value defining a pulse period and a high width of the switch pulse signal. The high width of the switch pulse signal may be changed by 1 period of the reference clock during the alignment period, compared with the normal period, and a low width of the switch pulse signal is the same in the normal period and the alignment period.

In another aspect, a method of controlling a power integrated circuit (PIC) for a display device may include aligning a duty ratio of a switch pulse signal within an alignment period set within a frame blank period.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1:
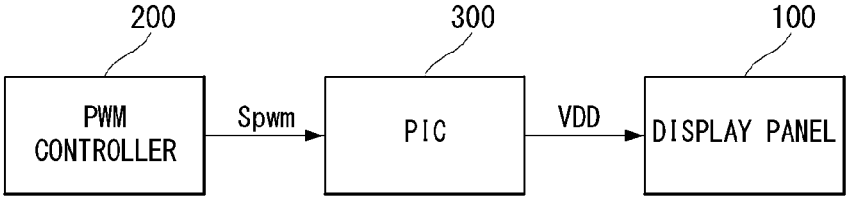
FIG. 1 is a block diagram illustrating a power control device of a display device according to an embodiment of the present disclosure.

Hereinafter, embodiments of the present disclosure will be described in detail with reference to the accompanying drawings. Throughout the specification, the like reference numerals denote the substantially same elements. In describing the present invention, if a detailed explanation for a related known function or construction is considered to unnecessarily divert the gist of the present invention, such explanation will be omitted but would be understood by those skilled in the art. Names of elements used in the following description are selected for the description purpose and may be different from those of actual products.

A display device of the present disclosure may be implemented as a display device such as a liquid crystal display (LCD), a field emission display (FED), a plasma display panel (PDP), or an organic light emitting display device, and the like. Hereinafter, an organic light emitting display device will be largely described as an example in an embodiment of the present disclosure, but the present disclosure is not limited thereto.

Ripples of a driving voltage used in a display device negatively affect image quality of an image displayed on a display panel. In order to solve an image quality problem due to ripples of an output voltage (power ripple) of the PIC (power integrated circuit), a switch pulse signal Spwm of the PIC is synchronized with each frame blank period of an input image signal and supplied to the PIC. When the switch pulse signal Spwm is initialized, a duty ratio of the switch pulse signal Spwm may be instantly changed. Here, if the change in duty ratio of the switch pulse signal Spwm is significant, an output voltage of the PIC is greatly changed. In order to prevent this, in the present disclosure, the change in the duty ratio of the switch pulse signal Spwm is minimized by setting an alignment period varied according to an asynchronization time when the switch pulse signal Spwm of the integrated circuit is initialized.

Figure 2:
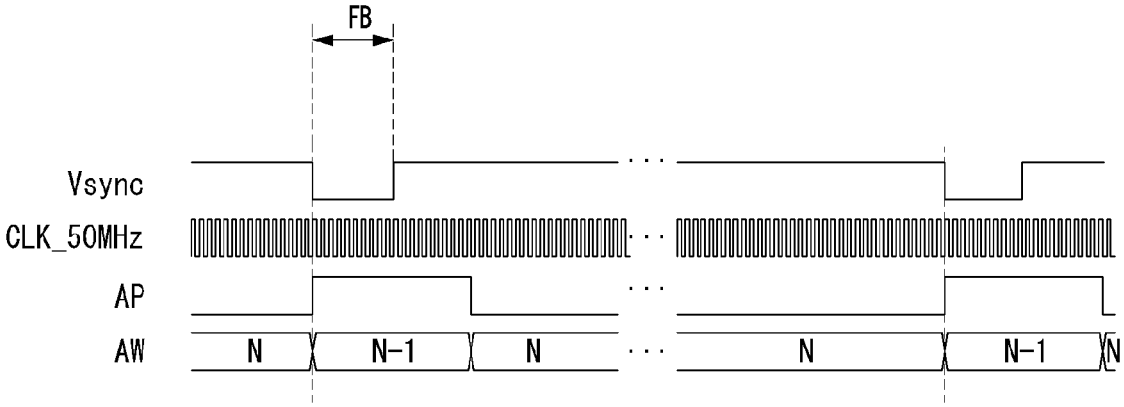
FIG. 2 is a waveform view illustrating an alignment period for reducing a change in a duty ratio of a switch pulse signal for controlling a power integrated circuit (PIC) when the switch pulse signal is initialized during a frame blank period.

FIG. 1 is a block diagram illustrating a power control device of a display device according to an embodiment of the present disclosure, and FIG. 2 is a waveform view illustrating an alignment period for reducing a change in a duty ratio of a switch pulse signal for controlling a power integrated circuit (PIC) when the switch pulse signal is initialized during a frame blank period. All the components of the display device according to all embodiments of the present disclosure are operatively coupled and configured.

Referring to FIGS. 1 and 2, a power control device of the present disclosure includes a PWM controller 200 and a PIC 300.

The PIC 300 generates DC power required for driving a display panel 100 using a DC-DC converter. The DC-DC converter includes a charge pump, a regulator, a buck converter, a boost converter, and the like. The PIC 300 aligns an output voltage according to a duty ratio of a switch pulse signal Spwm. When a duty ratio of the switch pulse signal Spwm is increased, an output voltage of the PIC 30 is increased, whereas when the duty ratio of the switch pulse signal Spwm is decreased, an output voltage of the PIC 30 is decreased.

Figure 3:
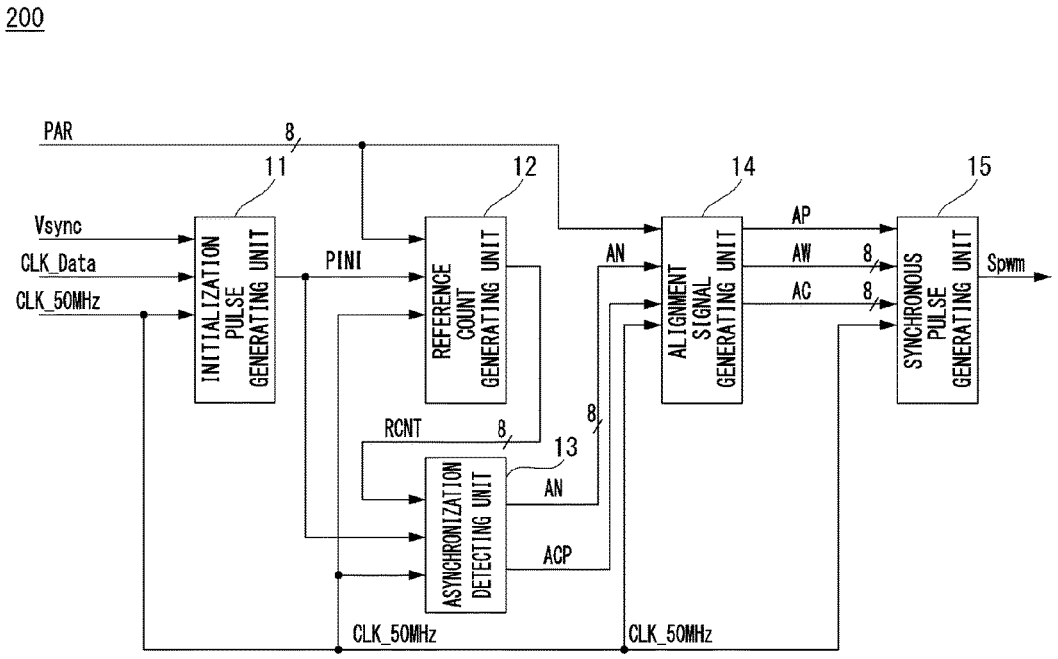
FIG. 3 is a block diagram specifically illustrating a pulse width modulation (PWM) controller according to an embodiment of the present disclosure.
Figure 4:
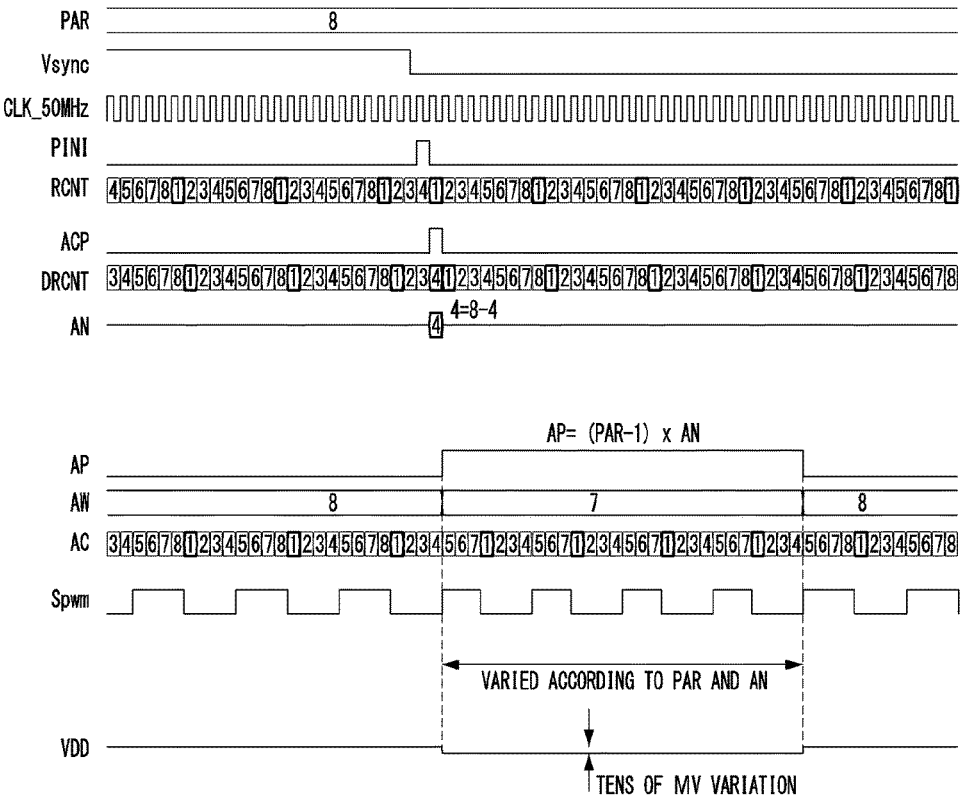
FIG. 4 is a waveform view illustrating an operation of a PWM controller according to an embodiment of the present disclosure.

The PWM controller 200 receives a pulse width parameter value PAR, a vertical synchronization signal Vsync, a data clock CLK_Data, and a reference clock CLK_50 MHz. The pulse width parameter value PAR is a parameter value defining a reference pulse period and a reference pulse width (or a high width) of the switch pulse signal Spwm. When the pulse width parameter value PAR is N (N is a positive integer ranging from 8 to 100), a reference pulse period of the switch pulse signal Spwm is set to N period of a reference clock CLK_50 MHz and a reference pulse width of the switch pulse signal Spwm is set to N/2. In the example of FIGS. 3 and 4, the pulse width parameter value PAR is set to 8.

Figure 6:
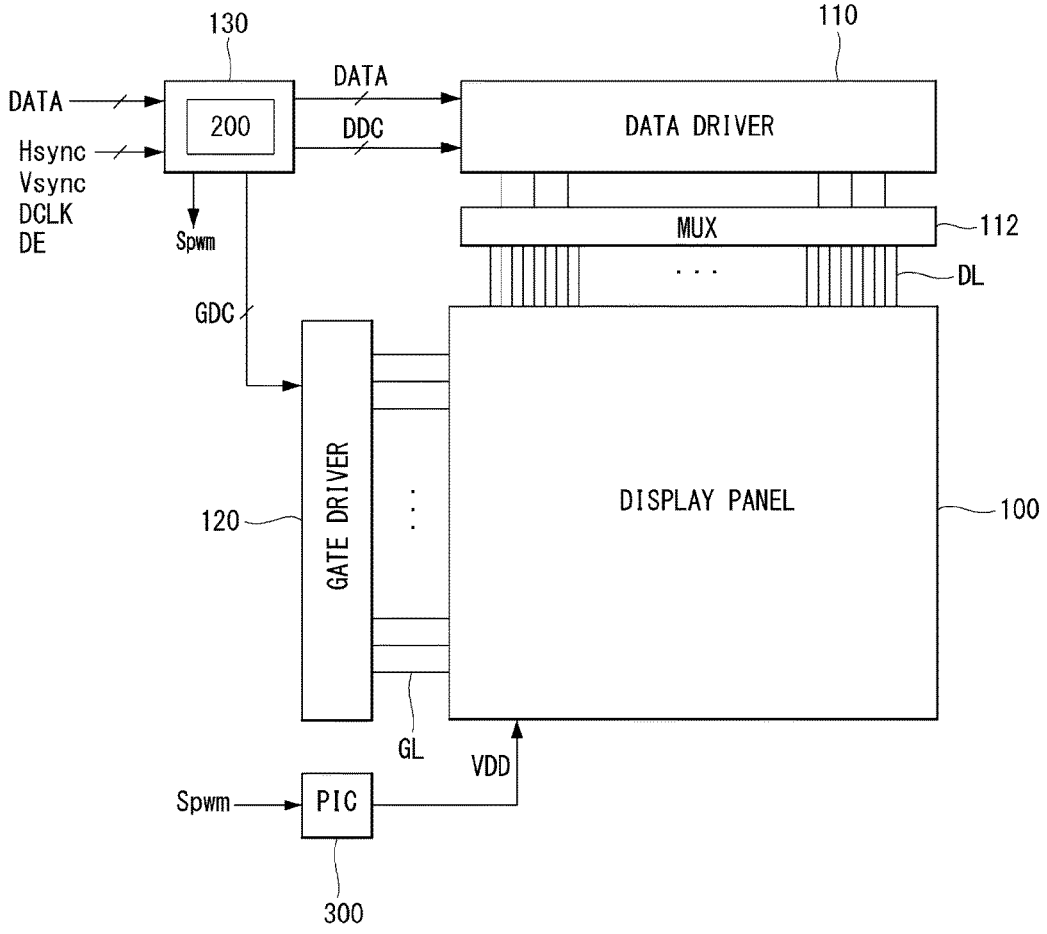
FIG. 6 is a block diagram illustrating an organic light emitting display device according to an embodiment of the present disclosure.

The pulse width parameter value PAR is a set value stored in an internal memory of a timing controller illustrated in FIG. 6. A vertical synchronization signal Vsync defines a frame period. When a frame rate is 60 Hz, a frame period is 16.67 ms, and when a frame rate is 50 Hz, a frame period is 20 ms. The frame period is divided into an active section (or a normal section) in which data of an input image is received and a frame blank section in which data is not received.

When a count value of the reference clock CLK_50 MHz is different from the pulse width parameter value PAR in a falling edge of the vertical synchronization signal Vsync, the PWM controller 200 initializes the switch pulse signal Spwm within an alignment period AP varied according to a count value not synchronized with the pulse width parameter value PAR. An alignment width AW of the switch pulse signal Spwm is a "pulse width parameter value PAR−1" during the alignment period AP. When the switch pulse signal Spwm is initialized, the PWM controller 200 aligns a change in a duty ratio of the switch pulse signal Spwm to be 3% or less.

FIG. 3 is a block diagram specifically illustrating a pulse width modulation (PWM) controller 200. FIG. 4 is a waveform view illustrating an operation of the PWM controller 200.

Referring to FIGS. 3 and 4, the PWM controller 200 includes an initialization pulse generating unit 11, a reference count generating unit 12, an asynchronization detecting unit 13, an alignment signal generating unit 14, and a synchronous pulse generation unit 15.

The PWM controller 200 initializes the switch pulse signal Spwm at a falling edge of the vertical synchronization signal Vsync and widely disperses an alignment period of the switch pulse signal Spwm generated to have a pulse width different from a pulse width in a preset pulse width parameter value PAR (=AP). 1 period of the switch pulse signal Spwm generated during a normal period other than the alignment period AP is PAR×(1/CLK_50 MHz). Meanwhile, 1 period of the switch pulse signal Spwm generated during the alignment period AP is (PAR−1)×(1/CLK_50 MHz).

The initialization pulse generating unit 11 receives a vertical synchronization signal Vsync, a data clock CLK_Data, and a reference clock CLK_50 MHz.

The reference clock CLK_50 MHz is uniformly generated regardless of frame rate of an input image signal. The reference clock CLK_50 MHz is set to a clock of a 50 MHz frequency, for example, but the frequency is not limited thereto. Meanwhile, the data clock CLK_Data is synchronized with an input image signal, and thus, it is varied according to a frame rate or resolution of the input image signal.

The initialization pulse generating unit 11 detects a falling edge timing of a vertical synchronization signal Vsync synchronized with the input image signal at a timing of the reference clock CLK_50 MHz and generates an initialization pulse PINI synchronized with a falling edge of the vertical synchronization signal. A rising edge of the initialization pulse PINI is synchronized with a rising edge of the reference clock CLK_50 MHz which is first input after the falling edge of the vertical synchronization signal Vsync. The initialization pulse generating unit 11 synchronizes an input image signal and an operation of the PIC 200 during a frame blank period FB at every frame period in units of frame period of the input image signal. The initialization pulse PINI is supplied to the reference count generating unit 12 and the asynchronization detecting unit 13.

The reference count generating unit 12 counts the reference clock CLK_50 MHz and accumulates values of a reference count RCNT from 1 to the pulse width parameter value PAR, and when the count value is equal to the pulse width parameter value PAR, the reference count generating unit 12 initializes the reference count RCNT to 1 and repeatedly accumulates count values. Also, the reference count generating unit 12 initializes the reference count RCNT to 1 in response to the initialization pulse PINI. In the example of FIG. 4, in response to the initialization pulse PINI, the reference count generating unit 12 resets the reference count RCNT and increases a count value after the initialization pulse PINI, starting from 1, again.

The asynchronization detecting unit 13 samples a last count value immediately before the reference clock CLK_50 MHz is initialized in synchronization with the initialization pulse PINI, and stores the sampled value in a memory to check a time not synchronized with the pulse width parameter value PAR. To this end, the asynchronization detecting unit 13 generates a reference count value DRCNT by delaying the reference count RCNT by 1 pulse of the reference clock CLK_50 MHz. The asynchronization detecting unit 13 generates an asynchronous check pulse ACP by delaying the initialization pulse PINI by 1 pulse of the reference clock CLK_50 MHz. Also, when the asynchronous check pulse ACP is in high logic state (H or ACP=1), the asynchronization detecting unit 13 samples the delayed reference count value DRCNT, stores the same as a last count value LCNT in the memory, and outputs an alignment number AN indicating the number of reference clocks CLK_50 MHz during an alignment time.

The asynchronization detecting unit 13 supplies the asynchronous check pulse ACP and the alignment number AN to the alignment signal generating unit 14. The alignment number AN is calculated as AN=PAR−LCNT. In the example of FIG. 4, since LCNT=4, AN=PAR−LCNT=8−4=4.

The alignment signal generating unit 14 receives the pulse width parameter value PAR, the asynchronous check pulse ACP, the alignment number AN, and the reference clock CLK_50 MHz. The alignment signal generating unit 14 generates signals for dispersing the alignment time more widely. The alignment signal generating unit 14 generates an alignment period AP, an alignment width AW, and an alignment count AC. The alignment period AP is a time obtained by adding the number of pulses of the reference clock CLK_50 MHz such as AP=(PAR−1)×(AN). Thus, the alignment period AP is varied according to the pulse width parameter value PAR and the alignment number AN. The alignment width AW is equal to "pulse width parameter value PAR−1" during the alignment period AP and is equal to the pulse width parameter value PAR during a normal period, other than during the alignment period AP.

The alignment period AP starts from a rising edge of a first pulse of the reference clock CLK_50 MHz immediately after the asynchronous check pulse ACP. During the alignment period AP, a change in a duty ratio of the switch pulse signal Spwm is dispersed. In the example of FIG. 4, AP=(PAR−1)×(AN)=7×4=28. When the alignment width signal has a high logic level (AP=1), it is an alignment period AP. During the alignment period AP (AP=1), AW (AP=1)=PAR−1, Meanwhile, AW=PAR during a normal period (AP=0) other than the alignment period AP. In the example of FIG. 4, AW (AP=1)=PAR−1=7 and AW (AP=0)=PAR=8.

The alignment count AC repeats the alignment width AW. In the example of FIG. 4, during the normal period (AP=0) other than the alignment period, the alignment count AC accumulates count values from 1 to AW (AP=0)=8 and repeats the same. During the alignment period (AP=1), the alignment count AC starts to accumulate count values up to AW (AP=1)=7 by accumulating 1 to each of the previous count values, subsequently accumulates count values from 1 to AW (AP=1)=7, and repeats the same. During the normal period (AP=0), other than the alignment period AP, the alignment count AC is equal to a delayed reference count value DRCNT, and after the alignment period AP, the alignment count AC accumulates count values up to AW (AP=0)=8 by accumulating 1 to the previous count values, subsequently accumulates count values from 1 to AW (AP=0)=8, and repeats the same.

The synchronous pulse generation unit 15 receives the alignment period AP, the alignment width AW, the alignment count AC, and the reference clock CLK_50 MHz from the alignment signal generating unit 14. The synchronous pulse generation unit 15 outputs a switch pulse signal Spwm whose duty ratio is aligned by 1 pulse period of the reference clock CLK_50 MHz during the alignment period AP and transmits the same to the PIC 300. A high width (or pulse width) of the switch pulse signal Spwm is a value obtained by dividing the alignment width AW by 2 and discarding digits to the right of the decimal point. A low width (or pulse width) of the switch pulse signal Spwm is calculated as a value obtained by subtracting the high width from the alignment width AW.

In the example of FIG. 4, during the alignment period AP, a high width of the switch pulse signal Spwm is AW/2=3. During a normal period other than the alignment period AP, a high width of the switch pulse signal Spwm is AW/2=4.

During the alignment period AP, a low width of the switch pulse signal Spwm is AW−High width=4. During a normal period other than the alignment period AP, a low width of the switch pulse signal Spwm is AW−High width=4. Meanwhile, when AW=29, a high width of the switch pulse signal Spwm is AW/2=14, and a low width of the switch pulse signal Spwm is AW−High width=15. A duty ratio of the switch pulse signal Spwm is H/T, where T is a period and H is a high width. The period is a value obtained by adding a high width and a low width.

As described above, the PWM controller 200 initializes the switch pulse signal Spwm at every frame blank period FB of each frame period such that an alignment period of the switch pulse signal Spwm is widely dispersed in the frame blank period FB and a change in a duty ratio thereof is minimized, i.e., reduced to 3% or less, thus preventing abnormal driving of the display panel. Pulses whose duty ratio is reduced in the switch pulse signal Spwm during the alignment period AP are generated by the alignment number (AN). In the example of FIG. 4, during the alignment period AP, four pulses have a reduced duty ratio in the switch pulse signal Spwm.

An ON duty (=high width) of the switch pulse signal Spwm output from the PWM controller 200 is changed by 1 period of the reference clock CLK_50 MHz during the alignment period AP. In contrast, a low width of the switch pulse signal Spwm is the same in the normal period and the alignment period.

When the pulse width parameter value PAR is 32, during the normal period other than the alignment period AP, a duty ratio of the switch pulse signal Spwm is 50% (16/32), and during the alignment period, a duty ratio of the switch pulse signal Spwm is 48% (15/31). When PAR is 50, during the normal period, a duty ratio of the switch pulse signal Spwm is 50% (25/50), and during the alignment period AP, a duty ratio of the switch pulse signal Spwm is 49% (24/49). Thus, a duty ratio of the normal period is 100%, the duty ratio of the switch pulse signal Spwm during the alignment period AP is reduced to 3% or less over the normal period.

In a commercial PMIC, when the present disclosure is applied in a frequency ranging from 400 KHz to 1.5 MHz of the switch pulse signal Spwm, a duty ratio of the switch pulse signal Spwm is changed to 3% or less between the normal period and the alignment period AP. When the present disclosure is applied to a PMIC in which a frequency range of the switch pulse signal Spwm is reduced to 1 MHz to 1.2 MHz, a duty ratio of the switch pulse signal Spwm may be controlled to be 1% or less between the normal period and the alignment period AP.

As a result, in the present disclosure, a variation of an output voltage VDD of the PIC may be controlled to tens of μV or less. According to a result of application of the present disclosure, the switch pulse signal Spwm is initialized such that a change in a duty ratio thereof is minimized during the frame bland period FB, a user may not recognize a change in brightness of the display panel.

Figure 5:
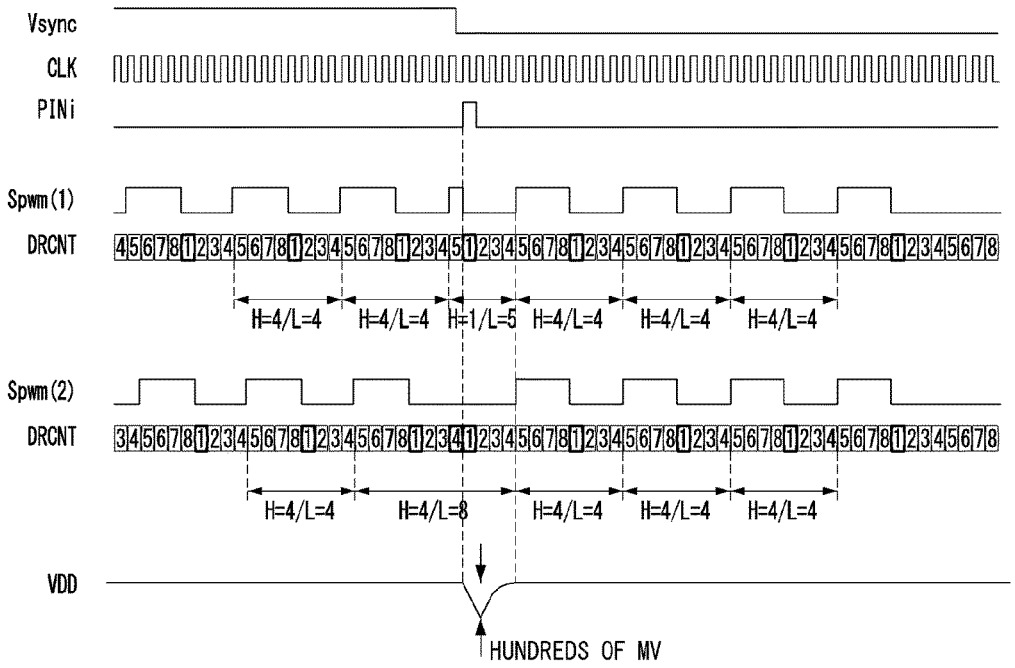
FIG. 5 is a waveform view illustrating a comparative example to which the present disclosure is not applied.

In contrast, in a comparative example (FIG. 5) to which the present disclosure/invention is not applied, variations of duty ratios of the switch pulse signals Spwm1 and Spwm2 are tens of % or greater and variations of the output voltage VDD of the PIC are hundreds of mV or greater, and thus, screen noise of the display panel may be recognized by the user. In FIG. 5, H=4 and H=1 are high widths of the scan pulse signal and L=4, L=5, and L=8 are low widths of the scan pulse signal.

Figure 7:
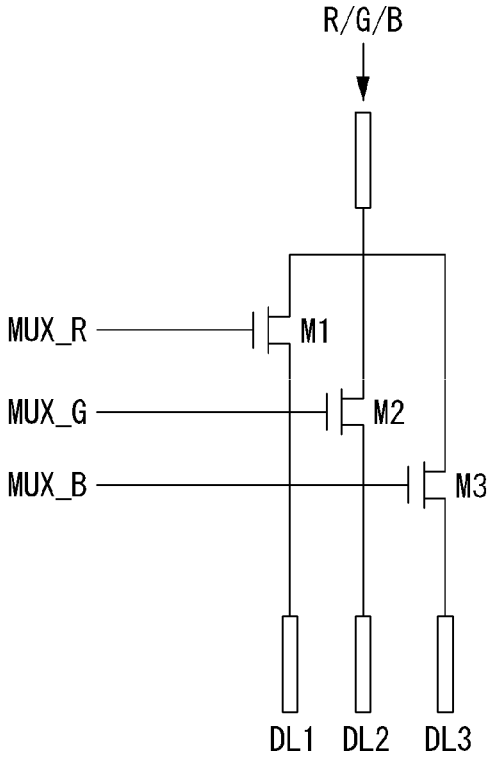
FIG. 7 is a view illustrating a multiplexer of FIG. 6.
Figure 8:
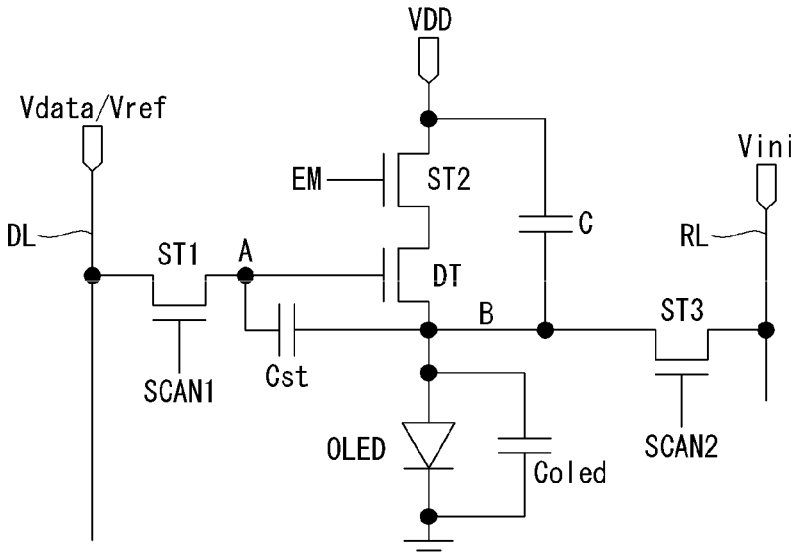
FIG. 8 is a circuit diagram illustrating an example of a pixel circuit of FIG. 6.

FIGS. 6 to 8 are views illustrating an example of an organic light emitting display device employing the method of controlling a PIC according to an embodiment of the present disclosure.

Referring to FIGS. 6 to 8, the organic light emitting display device according to an embodiment of the present disclosure includes a display panel 100, a PIC 300, a timing controller 130, and display panel driving circuits 110, 112, and 120.

The PIC 300 is driven according to a switch pulse signal Spwm input from a PWM controller 200 and aligns a voltage level according to a duty ratio of the switch pulse signal Spwm. The PIC 300 outputs a driving signal of each of IC chips of the display driving circuits and power, e.g., a pixel driving voltage VDD, required for driving the display panel 100.

As in the embodiment described above, the PWM controller 200 initializes the switch pulse signal Spwm within a frame blank period FB, and controls a duty ratio of the switch pulse signal Spwm to 3% or less, compared with a normal period, during the initialization period. The PWM controller 200 may be installed in the timing controller 130, but the present disclosure is not limited thereto.

The display panel driving circuits write data of an input image to pixels of the display panel 100. The display panel driving circuits include a data driver 110 and a gate driver 120 driven under the control of the timing controller 130.

Touch sensors may be disposed in the display panel 100. In this case, the display panel driving circuits further includes a touch sensor driver. In the case of a mobile device, the display panel driving circuits 110, 112, and 120 and the timing controller 130 may be integrated in a single drive integrated circuit (IC).

In the display panel, a plurality of data lines DL and a plurality of gate lines GL intersect with each other and pixels are disposed in a matrix form. Data of an input image is displayed in a pixel array of the display panel 100. The display panel 100 may further include an initialization voltage line (RL of FIG. 8) and a VDD line supplying the pixel driving voltage VDD to pixels.

The gate lines GL include a plurality of first scan lines to which a first scan pulse (SCAN1 of FIG. 9) is supplied, a plurality of second scan lines to which a second scan pulse (SCAN 2 of FIG. 9), and a plurality of EM signal lines to which an emission control signal EM is supplied.

Each of the pixels includes a red subpixel, a green subpixel, and a blue subpixel for color implementation. Each of the pixels may further include a white subpixel. Lines such as a data line, a first scan line, a second scan line, an EM control line, a VDD line, and the like, are connected to each of the pixels.

The data driver 110 converts digital data DATA of the input image received from the timing controller 130 in every frame into a data voltage, and supplies the data voltage to the data lines 14. The data driver 110 outputs a data voltage using a digital-to-analog converter (DAC) converting the digital data into a gamma compensation voltage.

A multiplexer MUX 112 may be disposed between the data driver 110 and the data lines DL of the display panel 100. The multiplexer 112 may distribute a data voltage output from the data driver 110 through a single output channel by N (N is a positive integer of 2 or greater) to reduce the number of output channels of the data driver 110. The multiplexer 112 may be omitted according to resolution and a purpose of a display device. The multiplexer 112 is configured as a switch circuit such as that of FIG. 2, and the switch circuit is turned on and off under the control of the timing controller 130. A switch circuit of FIG. 7 is an example of a switch circuit of a 1:3 multiplexer. This switch circuit includes first to third switches M1, M2, and M3 disposed between a specific data output channel and three data lines DL1 to DL3. The specific data output channel refers to a single output channel in the data driver 110. In response to a first MUX selection signal MUX_R, the first switch M1 transmits a first data voltage R input through the specific data output channel to the first data line DL1. Subsequently, in response to a second MUX selection signal MUX_G, the second switch M2 transmits a second data voltage G input through the specific data output channel to the second data line DL2, and thereafter, in response to a third MUX selection signal MUX_B, the third switch M3 transmits a third data voltage B input through the specific data output channel to the third data line DL3.

The gate driver 120 outputs scan pulses SCAN1 and SCAN2 and an EM signal to select pixels for charging a data voltage through gate lines GL and adjusts an emission timing under the control of the timing controller 130. The gate driver 120 shifts the scan pulses SCAN1 and SCAN2 and the EM signal using a shift register to thereby sequentially supply the signals to the gate lines GL. The shifter register of the gate driver 120 may be directly formed on a substrate of the display panel 100 together with a pixel array through a gate-in panel (GIP) process.

The timing controller 130 receives digital video data DATA of an input image from a host system and a timing signal synchronized therewith. The timing controller 130 transmits data of the input image to the data driver 110. The timing signal includes a vertical synchronization signal Vsync, a horizontal synchronization signal Hsync, a clock signal DCLK, a data enable signal DE, and the like. The host system may be any one of a TV system, a set-top box (STB), a navigation system, a DVD player, a Blu-ray player, a personal computer (PC), a home theater system, and a phone system.

The timing controller 130 may control an operation timing of the display panel driving units 110, 112, and 120 by a frame frequency of an input frame frequency×i (I is a positive integer greater than 0) by multiplying an input frequency by i times. The input frame frequency is 60 Hz in an NTSC (National Television Standards Committee) scheme, and 50 Hz in a PAL (Phase-Alternating Line) scheme.

The timing controller 130 generates a timing control signal DDC for controlling an operational timing of the data driver 110, a MUX selection signal MUX_R, MUX_G, and MUX_B for controlling an operational timing of the multiplexer 112, and a gate timing control signal GDC for controlling an operational timing of the gate driver 120 on the basis of timing signals Vsync, Hsync, and DE received from the host system.

The data timing control signal DDC includes a source start pulse SSP, a source sampling clock SSC, a polarity control signal POL, a source output enable signal SOE, and the like. The source start pulse SSP controls a sampling start timing of the data driver 110. The source sampling clock SSC is a clock shifting a data sampling timing. The polarity control signal POL controls a polarity of a data signal output from the data driver 102. When a signal transmission interface between the timing controller 130 and the data driver 110 is a mini LVDS (Low Voltage Differential Signaling), the source start pulse SSP and the source sampling clock SSC may be omitted.

The gate timing control signal GDC includes a gate start pulse VST, a gate shift clock GSC (hereinafter, referred to as a "clock CLK"), and a gate output enable signal GOE, and the like. In the case of a GIP circuit, the gate output enable signal GOE may be omitted. The gate start pulse VST is generated once at an initial stage of each frame period and input to the shift register. The gate start pulse VST controls a start timing at which a gate pulse of a first block is output at every frame period. The clock CLK is input to the shift register to control a shift timing of the shift register. The gate output enable signal GOE defines an output timing of a gate pulse.

Each of the pixels includes an OLED, a plurality of thin film transistors (TFTs) ST1 to ST3 and DT, and a storage capacitor Cst, as shown in FIG. 8. A capacitor C may be connected between a drain electrode of a second TFT ST2 and a second node B. In FIG. 8, "Coled" indicates a parasitic capacitance of the OLED.

The OLED emits light by a current amount adjusted by the driving TFT DT according to a data voltage Vdata. A current path of the OLED is switched by a second switch TFT ST2. The OLED includes an organic compound layer formed between an anode and a cathode. The organic compound layer may include a hole injection layer HIL, a hole transport layer (HTL), an emission layer (EML), an electron transport layer (ETL), and an electron injection layer (EIL), but the present disclosure is not limited thereto. An anode electrode of the OLED is connected to the second node B, and a cathode electrode of the OLED is connected to a VSS line to which a ground voltage VSS is applied.

The TFTs ST1 to ST3 are illustrated as n type MOSFETs in FIG. 3, but the present disclosure is not limited thereto. For example, the TFTs ST1 to ST3 may be implemented as p type MOSFETs. In this case, the TFTs ST1 to ST3 and DT may be p type MOSFETs. In this case, phases of the scan signals SCAN1 and SCAN2 and the EM signal EM are reversed. The TFTs may be implemented as any one of amorphous silicon (a-Si) transistors, polycrystalline silicon transistors, and oxide transistors, or any combination thereof.

An OFF period of the switching TFTs ST1 and ST3 used as switching elements are lengthened in a low speed driving mode. Thus, in order to reduce an OFF current, i.e., a leakage current, of the switching TFTs ST1 and ST3 in the low speed driving mode, the switching TFTs ST1 and ST3, preferably, the switching transistors TFTs ST1 and ST3 are implemented as oxide transistors including an oxide semiconductor material. When the switching TFTs ST1 and ST3 are implemented as oxide transistors, an OFF current may be reduced to reduce power consumption and prevent a reduction in a voltage of pixels due to a leakage current as well, whereby a flicker preventing effect may be increased.

Preferably, the driving TFT DT used as a driving element and the switching TFT ST2 short in an OFF period are implemented as polycrystalline silicon transistors including a polycrystalline semiconductor material. The polycrystalline silicon transistors have high electron mobility, increasing a current amount of the OLED to increase efficiency, and thus, power consumption may be improved.

An anode electrode of the OLED is connected to the driving TFT DT by way of the second node B. A cathode electrode of the OLED is connected to a base voltage source and the ground voltage VSS is supplied thereto. The ground voltage may be a low potential DC voltage of a negative polarity.

The driving TFT DT is a driving element adjusting a current Ioled flowing in the OLED according to a voltage Vgs between a gate and a source. The driving TFT DT includes a gate electrode connected to the first node A, a drain electrode connected to the second switching TFT ST2, and a source electrode connected to the second node B. The storage capacitor Cst is connected between the first node A and the second node B to hold the voltage Vgs between the gate and the source of the driving TFT DT.

The first switching TFT ST1 is a switching element supplying a data voltage Vdata to the first node A in response to the first scan pulse SCAN1. The first switching TFT ST1 includes a gate electrode connected to the first scan line SCAN1, a drain electrode connected to the data line DL, a source electrode connected to the first node A. The first scan signal SCAN1 is generated to have an ON level substantially during 1 horizontal period 1H to turn on the first switching TFT ST1 and reversed to an OFF level during an emission period tem to turn off the first switching TFT ST1.

The second switching TFT ST2 is a switching element switching a current flowing in the OLED in response to the EM signal EM. A drain electrode of the second switch TFT ST2 is connected to a VDD line to which a pixel driving voltage VDD is supplied. A source electrode of the second switching TFT ST2 is connected to a drain electrode of the driving TFT DT. A gate electrode of the second switching TFT ST2 is connected to the EM signal line to receive the EM signal EM. The EM signal EM is generated to have an ON level during a sampling period is to turn on the second switching TFT ST2 and reversed to an OFF level during an initialization period ti and a programming period tw to turn off the second switching TFT ST2. Also, the EM signal EM is generated to have an ON level during the emission period tem to turn on the second switching TFT ST2 to form a current path of the OLED. The EM signal EM may generated as an AC signal swung between an ON level and an OFF level according to a preset PWM duty ratio to switch a current path of the OLED.

The third switch TFT ST3 supplies an initialization voltage Vini to the second node B in response to the second scan pulse SCAN2 during the initialization period ti. The third switching TFT ST3 includes a gate electrode connected to a second scan line, a drain electrode connected to an initialization voltage line RL, and a source electrode connected to the second node B. The second scan signal SCAN2 is generated to have an ON level within the initialization period ti to turn on the third switching TFT ST3 and holds an OFF level during a remaining period to control the third switching TFT ST3 in an OFF state.

The storage capacitor Cst is connected between the first node A and the second node B to storage a difference voltage between both ends. The storage capacitor Cst samples a threshold voltage Vth of the driving TFT DT in a source-follower manner. The capacitor C is connected between the VDD line and the second node B. When a potential of the first node A is changed according to the data voltage Vdata during the programming period tw, the capacitors Cst and C voltage-distribute a variation thereof and reflect the same in the second node B.

A scanning period of a pixel is divided into the initialization period ti, the sampling period ts, the programming period tw, and the emission period tw. The scanning period is set to substantially 1 horizontal period 1H to write data into pixels arranged in the 1 horizontal line of a pixel array. During the scanning period, a threshold voltage of the driving TFT DT is sampled and a data voltage is compensated by the threshold voltage. Thus, during the 1 horizontal period 1H, data DATA of an input image is compensated by the threshold voltage of the driving TFT DT and written into the pixels.

Figure 9:
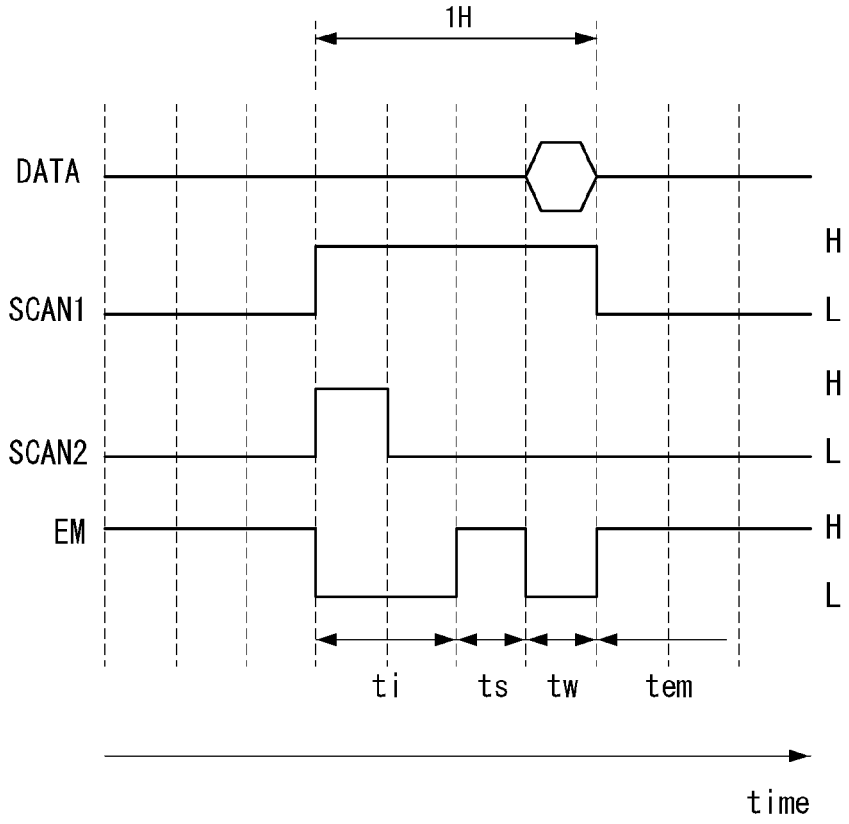
FIG. 9 is a waveform view illustrating signals input to a pixel of FIG. 6.

When the initialization period ti starts, the first and second scan pulses SCAN1 and SCAN2 rise to be generated to have an ON level. Simultaneously, the EM signal EM falls to be changed to an OFF level. During the initialization period ti, the second switching TFT ST2 is turned off to block a current path of the OLED. The first and third switching TFTs ST1 and ST3 are turned on during the initialization period ti. During the initialization period ti, a predetermined reference voltage Vref is supplied to the data line DL. During the initialization period ti, a voltage of the first node A is initialized to the reference voltage Vref, and a voltage of the second node B is initialized to a predetermined initialization voltage Vini. After the initialization period ti, the second scan pulse SCAN2 is changed to an OFF level to turn off the third switching TFT ST3. The ON level is a gate voltage level of the TFT at which the switching TFTs ST1 to ST3 of the pixels are turned on. The OFF level is a gate voltage level at which the switching elements T2 to T4 of the pixels are turned off. In FIG. 9, "H (=High)" represents the ON level and "L (=Low)" represents the OFF level.

During the sampling period ts, the first scan pulse SCAN1 holds the ON level, and the second scan pulse SCAN2 holds the OFF level. When the sampling period ts starts, the EM signal EM rises to be changed to the ON level. During the sampling period ts, the first and second switching TFTs ST1 and ST2 are turned on. During the sampling period ts, the second switch TFT ST2 is turned on in response to the EM signal EM having the ON level. During the sampling period ts, the first switching TFT ST1 holds the ON state by the first scan signal SCAN1 having the ON level. During the sampling period ts, the reference voltage Vref is supplied to the data line DL. During the sampling period ts, a potential of the first node A is held as the reference voltage Vref, while a potential of the second node B is increased by a current Ids between the drain and the source. According to such a source-follower scheme, the voltage Vgs between the gate and the source of the driving TFT DT is sampled as a threshold voltage Vth of the driving TFT DT, and the sampled threshold voltage Vth is stored in the storage capacitor Cst. During the sampling period ts, a voltage of the first node A is the reference voltage Vref, and a voltage of the second node B is Vref−Vth.

During the programming period tw, the first switching TFT ST1 holds the ON state according to the first scan signal SCAN1 having the ON level, and the other switching TFTs ST2 and ST3 are turned off. During the programming period tw, the data voltage Vdata of the input image is supplied to the data line DL. As the data voltage Vdata is applied t the first node A and a result of voltage distribution between the capacitors Cst and C regarding the voltage variation Vdata−Vref of the first node A is reflected in the second node B, the voltage Vgs between the gate and the source of the driving TFT DT is programmed. During the programming period tw, a voltage of the first node A is the data voltage Vdata, and a voltage of the second node B is Vref−Vth+C'*(Vdata−Vref) as the result (C'*(Vdata−Vref)) of voltage distribution between the capacitors Cst and C is added to the Vref−Vth set through the sampling period ts. As a result, the voltage Vgs between the gate and the source of the driving TFT DT is programmed as Vdata−Vref+Vth−C'*(Vdata−Vref) through the programming period tw. Here, C' is Cst/(Cst+C).

When the emission period tem starts, the EM signal EM rises to be changed to have the ON level again, whereas the first scan pulse SCAN1 falls to be changed to have an OFF level. During the emission period tem, the second switching TFT ST2 holds the ON state to form a current path of the OLED. During the emission period tem, the driving TFT DT adjusts a current amount of the OLED according to a data voltage.

The emission period tem continues from a point at which the programming period tw comes to an end to the initialization period ti of a subsequent frame. During the emission period tem, the current Ioled adjusted according to the voltage Vgs between the gate and the source of the driving TFT DT flows to the OLED to allow the OLED to emit light. During the emission period, the first and second scan signals SCAN1 and SCAN2 hold an OFF level, and thus, the first and third switches TFTs ST1 and ST3 are turned off.

During the emission period tem, the current Ioled flowing in the OLED is expressed by Equation (1) below. The OLED emits light by the current Ioled to express brightness of the input image.

$$Ioled = \frac{k}{2}[(1 - C')(Vdata - Vref)]^2 \quad (1)$$

Here, k is a proportional factor determined by mobility of the driving TFT DT, parasitic capacitance, channel capacity, and the like.

Since Vth is included in Vgs programmed through the programming period tw, Vth is erased from Ioled of Equation (1). Thus, an influence of the threshold voltage Vth of the driving element, i.e., the first TFT T1, on the current Ioled of the OLED is removed.

As described above, in the present disclosure, the switch pulse signal Spwm is synchronized to the input image and the switch pulse signal Spwm is initialized during the frame blank period, and here, an alignment period for dispersing a duty ratio of the switch pulse signal Spwm when the switch pulse signal Spwm is initialized is set, and the duty ratio of the switch pulse signal Spwm is aligned to 3% or less within the alignment period. As a result, in the present disclosure, a degradation of image quality is prevented by reducing a change in the duty ratio of the switch pulse signal Spwm when the switch pulse signal Spwm is initialized.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a display panel;

a controller configured to generate a switch pulse signal synchronized with an input image, and vary a duty ratio of the switch pulse signal during an alignment period set within a frame blank period in which the input image is not present; and a power integrated circuit (PIC) configured to be driven according to the switch pulse signal to generate power of the display panel, wherein the duty ratio of the switch pulse signal is aligned to be greater than 0 and equal to or less than 3% during the alignment period, compared with a normal period other than the alignment period.

2. The display device of claim 1, wherein the controller receives a reference clock generated to have a uniform frequency regardless of a frame rate and a pulse width parameter value defining a pulse period and a high width of the switch pulse signal, the high width of the switch pulse signal is changed by 1 period of the reference clock during the alignment period, compared with the normal period, and a low width of the switch pulse signal is the same in the normal period and the alignment period.

3. The display device of claim 1, wherein the controller comprises:

an initialization pulse generating unit that receives a vertical synchronization signal synchronized with the input image, a data clock synchronized with the input image, and a reference clock, and generates an initialization pulse synchronized with a falling edge of the vertical synchronization signal;

a reference count generating unit that counts the reference clock to accumulate values of a reference count from 1 to a pulse width parameter value, and initializes the reference count to 1 when the reference count is equal to the pulse width parameter value;

an asynchronization detecting unit that samples a last count value immediately before the reference clock is synchronized with the initialization pulse so as to be initialized, delays the reference count by 1 pulse of the reference clock to generate a delayed reference count, delays the initialization pulse by 1 pulse of the reference clock to generate an asynchronous check pulse, samples the delayed reference count to generate a last count value when the asynchronous check pulse is in a high logic state, and generates an alignment number obtained by subtracting the last count value from the pulse width parameter value;

an alignment signal generating unit that receives the pulse width parameter value, the asynchronous check pulse, the alignment number, and the reference clock, and generates the alignment period, an alignment width which is equal to (pulse width parameter value −1) during the alignment period and which is equal to the pulse width parameter value during the normal period, and an alignment count repeatedly counted to the alignment width; and a synchronous pulse generating unit that receives the alignment period, the alignment width, the alignment count, and the reference clock, and aligns a duty ratio of the switch pulse signal.

4. The display device of claim 3, wherein the alignment period is a time obtained by adding the number of pulses of the reference clock which is the same as a value obtained by multiplying the alignment number to a result obtained by 1 from the pulse width parameter value, and the alignment period starts from a rising edge of a first pulse of the reference clock immediately after the asynchronous check pulse.

5. The display device of claim 4, wherein a high width of the switch pulse signal is calculated as a value obtained by dividing the alignment width by 2 and discarding digits to the right of the decimal point, and a low width of the switch pulse signal is calculated as a value obtained by subtracting the high width from the alignment width.

6. A method of controlling a power integrated circuit (PIC) for a display device including a display panel, a controller configured to generate a switch pulse signal synchronized with an input image and vary a duty ratio of the switch pulse signal, and a power integrated circuit (PIC) driven according to the switch pulse signal to generate power of the display panel, the method comprising:

varying the duty ratio of the switch pulse signal during an alignment period set within a frame blank period in which the input image is not present, wherein the duty ratio of the switch pulse signal is aligned to be greater than 0 and equal to or less than 3% during the alignment period, compared with a normal period other than the alignment period.

7. The method of claim 6, wherein the varying the duty ration of the switch pulse signal comprises:

receiving a reference clock generated to have a uniform frequency regardless of a frame rate and a pulse width parameter value defining a pulse period and a high width of the switch pulse signal; and changing the high width of the switch pulse signal by 1 period of the reference clock during the alignment period, compared with the normal period, and controlling a low width of the switch pulse signal to be the same in the normal period and the alignment period.

8. The method of claim 7, wherein the varying the duty ratio of the switch pulse comprises:

receiving a vertical synchronization signal synchronized with the input image, a data clock synchronized with the input image, and the reference clock, and generating an initialization pulse synchronized with a falling edge of the vertical synchronization signal;

counting the reference clock to accumulate values of a reference count from 1 to a pulse width parameter value, and initializing the reference count to 1 when the reference count is equal to the pulse width parameter value;

sampling a last count value immediately before the reference clock is synchronized with the initialization pulse so as to be initialized, delaying the reference count by 1 pulse of the reference clock to generate a delayed reference count, delaying the initialization pulse by 1 pulse of the reference clock to generate an asynchronous check pulse, sampling the delayed reference count to generate a last count value when the asynchronous check pulse is in a high logic state, and generating an alignment number obtained by subtracting the last count value from the pulse width parameter value;

receiving the pulse width parameter value, the asynchronous check pulse, the alignment number, and the reference clock and generating the alignment period, an alignment width which is equal to (pulse width parameter value −1) during the alignment period and which is equal to the pulse width parameter value during the normal period, and an alignment count repeatedly counted to the alignment width; and receiving the alignment period, the alignment width, the alignment count, and the reference clock, and aligning a duty ratio of the switch pulse signal.

9. The method of claim 8, wherein the alignment period is a time obtained by adding the number of pulses of the reference clock which is the same as a value obtained by multiplying the alignment number to a result obtained by 1 from the pulse width parameter value, and the alignment period starts from a rising edge of a first pulse of the reference clock immediately after the asynchronous check pulse.

10. The method of claim 9, wherein a high width of the switch pulse signal is calculated as a value obtained by dividing the alignment width by 2 and discarding digits to the right of the decimal point, and a low width of the switch pulse signal is calculated as a value obtained by subtracting the high width from the alignment width.

11. A display device comprising:

a controller generating a switch pulse signal synchronized with an input image and varying a duty ratio of the switch pulse signal during an alignment period set within a frame blank period in which the input image is not present; and a power integrated circuit (PIC) driven according to the switch pulse signal to generate power of a display panel, wherein the controller receives a vertical synchronization signal synchronized with the input image, and the vertical synchronization signal is maintained at the same level during the alignment period, and wherein the duty ratio of the switch pulse signal is aligned to be greater than 0 and equal to or less than 3% during the alignment period, compared with a normal period other than the alignment period.

12. The display device of claim 11, wherein the controller receives a reference clock generated to have a uniform frequency regardless of a frame rate and a pulse width parameter value defining a pulse period and a high width of the switch pulse signal, the high width of the switch pulse signal is changed by 1 period of the reference clock during the alignment period, compared with the normal period, and a low width of the switch pulse signal is the same in the normal period and the alignment period.

13. The display device of claim 11, wherein the controller comprises:

an initialization pulse generating unit that receives a vertical synchronization signal synchronized with the input image, a data clock synchronized with the input image, and a reference clock, and generates an initialization pulse synchronized with a falling edge of the vertical synchronization signal;

a reference count generating unit that counts the reference clock to accumulate values of a reference count from 1 to a pulse width parameter value, and initializes the reference count to 1 when the reference count is equal to the pulse width parameter value;

an asynchronization detecting unit that samples a last count value immediately before the reference clock is synchronized with the initialization pulse so as to be initialized, delays the reference count by 1 pulse of the reference clock to generate a delayed reference count, delays the initialization pulse by 1 pulse of the reference clock to generate an asynchronous check pulse, samples the delayed reference count to generate a last count value when the asynchronous check pulse is in a high logic state, and generates an alignment number obtained by subtracting the last count value from the pulse width parameter value;

an alignment signal generating unit that receives the pulse width parameter value, the asynchronous check pulse, the alignment number, and the reference clock, and generates the alignment period, an alignment width which is equal to (pulse width parameter value −1) during the alignment period and which is equal to the pulse width parameter value during the normal period, and an alignment count repeatedly counted to the alignment width; and a synchronous pulse generating unit that receives the alignment period, the alignment width, the alignment count, and the reference clock, and aligns a duty ratio of the switch pulse signal.

14. The display device of claim 13, wherein the alignment period is a time obtained by adding the number of pulses of the reference clock which is the same as a value obtained by multiplying the alignment number to a result obtained by 1 from the pulse width parameter value, and the alignment period starts from a rising edge of a first pulse of the reference clock immediately after the asynchronous check pulse.

15. The display device of claim 14, wherein a high width of the switch pulse signal is calculated as a value obtained by dividing the alignment width by 2 and discarding digits to the right of the decimal point, and a low width of the switch pulse signal is calculated as a value obtained by subtracting the high width from the alignment width.

* * * * *